US009846995B2

(12) United States Patent
Gomez et al.

(10) Patent No.: US 9,846,995 B2
(45) Date of Patent: Dec. 19, 2017

(54) WAGERING GAME WITH MULTIPLE UNLOCKABLE ARRAYS

(71) Applicant: WMS Gaming Inc., Waukegan, IL (US)

(72) Inventors: Benjamin T. Gomez, Chicago, IL (US); Daniel P. Louie, Chicago, IL (US)

(73) Assignee: Bally Gaming, Inc., Las Vegas, NV (US)

( * ) Notice: Subject to any disclaimer, the term of this patent is extended or adjusted under 35 U.S.C. 154(b) by 0 days.

(21) Appl. No.: 13/794,204

(22) Filed: Mar. 11, 2013

(65) Prior Publication Data

US 2014/0031100 A1 Jan. 30, 2014

Related U.S. Application Data

(60) Provisional application No. 61/676,053, filed on Jul. 26, 2012.

(51) Int. Cl.
*G07F 17/34* (2006.01)
*G07F 17/32* (2006.01)

(52) U.S. Cl.
CPC ..... *G07F 17/34* (2013.01); *G07F 17/3265* (2013.01)

(58) Field of Classification Search
CPC ..... A63F 9/24
USPC ..... 463/16, 20
See application file for complete search history.

(56) References Cited

U.S. PATENT DOCUMENTS

| | | | | |
|---|---|---|---|---|
| 5,531,448 | A | 7/1996 | Moody | |
| 5,722,891 | A * | 3/1998 | Inoue | 463/20 |
| 5,732,950 | A | 3/1998 | Moody | |
| 5,788,573 | A * | 8/1998 | Baerlocher et al. | 463/16 |
| 5,823,873 | A | 10/1998 | Moody | |
| 5,954,335 | A | 9/1999 | Moody | |
| 5,976,016 | A | 11/1999 | Moody et al. | |
| 5,997,401 | A | 12/1999 | Crawford | |
| 6,007,066 | A | 12/1999 | Moody | |
| 6,033,307 | A * | 3/2000 | Vancura | 463/20 |
| 6,059,289 | A * | 5/2000 | Vancura | 273/143 R |
| 6,098,985 | A | 8/2000 | Moody | |
| 6,120,378 | A | 9/2000 | Moody et al. | |

(Continued)

OTHER PUBLICATIONS

"X Marks the Spot" published by WMS Gaming, publication date unkown, printed and accessed from URL <http://www.wms.com/Games/Mechanical/BonusBank/supermultiprogressive/Pages/XMarkstheSpot.aspx>, 1 page.*

(Continued)

*Primary Examiner* — Jason Skaarup
(74) *Attorney, Agent, or Firm* — Nixon Peabody LLP

(57) ABSTRACT

A gaming system for conducting a wagering game includes an input device, a display device, a processor, and a memory device. The memory device stores instructions that, when executed by the processor, cause the gaming system to receive a wager in response to an input, display a main array of symbol-bearing reels, and to display a plurality of enhanced arrays. The main array includes a plurality of enhanced-array triggers. Each enhanced array includes an enhancement feature and each enhanced array is associated with at least one of the plurality of enhanced-array triggers. The enhanced arrays are spun and evaluated upon display of the associated enhanced-array triggers.

20 Claims, 7 Drawing Sheets

(56) References Cited

U.S. PATENT DOCUMENTS 6,159,095 A 12/2000 Frohm et al.
6,168,520 B1 * 1/2001 Baerlocher et al. ..... 463/16
6,203,428 B1 3/2001 Giobbi et al.
6,270,412 B1 8/2001 Crawford et al.
6,311,978 B1 11/2001 Moody
6,315,291 B1 11/2001 Moody
6,364,313 B1 4/2002 Moody
6,419,578 B1 7/2002 Moody et al.
6,517,074 B1 2/2003 Moody et al.
6,561,898 B2 5/2003 Moody
6,561,904 B2 * 5/2003 Locke ..... G07F 17/32 463/20
6,568,680 B1 5/2003 Moody et al.
6,582,303 B1 * 6/2003 Weiss ..... 463/16
6,612,927 B1 * 9/2003 Slomiany et al. ..... 463/16
6,652,377 B1 11/2003 Moody
6,672,959 B2 1/2004 Moody et al.
6,935,947 B1 * 8/2005 Singer ..... G07F 17/3244 273/143 R
6,955,356 B2 10/2005 Moody
6,964,418 B2 11/2005 Moody
7,137,628 B2 11/2006 Moody
7,156,397 B2 1/2007 Moody et al.
7,222,857 B2 5/2007 Moody
7,222,858 B2 5/2007 Moody
7,404,762 B2 7/2008 Moody
7,431,644 B2 10/2008 Moody
7,481,708 B2 * 1/2009 Baerlocher et al. ..... 463/20
7,527,557 B2 5/2009 Jackson
7,594,851 B2 * 9/2009 Falconer ..... 463/20
7,727,069 B1 * 6/2010 Nelson ..... 463/31
7,758,416 B2 * 7/2010 Randall ..... G07F 17/34 463/20
8,066,563 B1 * 11/2011 Schultz et al. ..... 463/20
8,075,389 B1 * 12/2011 Schultz et al. ..... 463/20
8,246,443 B2 * 8/2012 Randall ..... 463/20
8,485,885 B2 * 7/2013 Suda ..... 463/20
8,628,400 B2 * 1/2014 Aoki ..... G07F 17/3262 463/20
8,986,093 B2 * 3/2015 Caputo ..... G07F 17/323 463/16
2002/0010017 A1 * 1/2002 Bennett ..... 463/20
2002/0086725 A1 * 7/2002 Fasbender ..... G07F 17/34 463/11
2003/0060266 A1 * 3/2003 Baerlocher ..... G07F 17/32 463/20
2005/0032566 A1 * 2/2005 Baerlocher et al. ..... 463/16
2005/0070353 A1 * 3/2005 Webb ..... G07F 17/32 463/16
2005/0130731 A1 * 6/2005 Englman ..... G07F 17/32 463/20
2005/0143165 A1 * 6/2005 Berman et al. ..... 463/20
2005/0233794 A1 * 10/2005 Cannon et al. ..... 463/16
2006/0121972 A1 * 6/2006 Walker ..... G07F 17/32 463/16
2006/0287036 A1 * 12/2006 Daly et al. ..... 463/16
2008/0108423 A1 * 5/2008 Benbrahim et al. ..... 463/25
2008/0113779 A1 * 5/2008 Cregan ..... G07F 17/3267 463/27
2009/0042652 A1 * 2/2009 Baerlocher et al. ..... 463/42
2009/0124326 A1 * 5/2009 Caputo et al. ..... 463/20
2009/0124391 A1 * 5/2009 Nelson ..... G07F 17/3258 463/42
2010/0120493 A1 * 5/2010 Hoffman ..... G07F 17/3267 463/20
2010/0160031 A1 * 6/2010 Gilliland ..... G07F 17/32 463/20
2010/0317425 A1 12/2010 Gomez et al.
2011/0105218 A1 5/2011 Anderson et al.
2011/0117988 A1 * 5/2011 DuBose ..... G07F 17/32 463/20
2011/0118001 A1 * 5/2011 Vann ..... G07F 17/34 463/20
2011/0244943 A1 * 10/2011 Milford ..... G07F 17/34 463/20
2011/0263312 A1 * 10/2011 De Waal et al. ..... 463/20
2013/0225268 A1 * 8/2013 Caputo ..... G07F 17/3244 463/25
2013/0237306 A1 * 9/2013 Meyer ..... G07F 17/3211 463/20
2013/0274011 A1 * 10/2013 Meyer ..... G07F 17/3267 463/31

OTHER PUBLICATIONS

"X Marks the Spot Slots Review" published by SlotsJam on or before Jul. 20, 2008, printed and accessed from URL <http://web.archive.org/web/20080720142928/http://www.slotsjam.com/bonusgames/x-marks-the-spot.html>, 3 pages.*

"Quick Hits Slot Machine Free Spin Bonus with 3 Retriggers!", published by bubblesonaraw43 via You Tube on Feb. 18, 2012, printed from URL <https://www.youtube.com/watch?v=jGP6xfPbqwY>, 2 pages.*

Game Search results showing various games including Quick Hit Black Gold Free Game Fever and Quick Hit Platinum Black Gold Wild available on or before Jul. 22, 2012, and printed from URL <https://www.ballytech.com/games/game-search/>, 3 pages.*

"Bally Alpha B&W Sevens W-Quick Hit", published by FORDSBS via You Tube on May 6, 2012, printed from URL <https://www.youtube.com/watch?v=V10HH-UhxBc>, 2 pages.*

"Quick Hit Platinum" Description published by Bally Gaming Inc. on or before Dec. 31, 2007, and printed from URL <http://web.archive.org/web/20160725070002/http://www.ballyfrance.fr/Documents/Quick%20Hit%20Platinum_3games_IE_lo.pdf>, 2 pages.*

"Quick Hit Black Gold Free Games Fever How to Play" Description published by Bally Games, data unknown, and printed from URL <https://games-newjersey.ballyinteractive.com/BallyGames/GameContent/Bally_QuickHitBlac . . . >, 6 pages.*

"Bally Alpha B&W Sevens W-Quick Hit" Video published by FORDSBS on or before May 6, 2012 at YouTube.com, printed from URL <https://www.youtube.com/watch?v=V10HH-UhxBc>, 5 pages.*

* cited by examiner

WAGERING GAME WITH MULTIPLE UNLOCKABLE ARRAYS

CROSS-REFERENCE TO RELATED APPLICATIONS

This application claims the benefit of U.S. Provisional Patent Application 61/676,053, filed on Jul. 26, 2012, which is hereby incorporated by reference in its entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming apparatus and methods and, more particularly, to displaying multiple enhanced arrays that are unlockable.

BACKGROUND OF THE INVENTION

Gaming terminals, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

SUMMARY OF THE INVENTION

According to one aspect of the present invention, a gaming system for conducting a wagering game includes at least one input device, at least one display device, at least one processor, and at least one memory device. The memory device stores instructions that, when executed by the at least one processor, cause the gaming system to receive a wager in response to an input via the at least one input device, display on the at least one display device a main array with a plurality of symbol-bearing reels, display on the at least one display device a plurality of enhanced arrays, and spin and evaluate the plurality of symbol bearing reels on the main array in response to the wager. The plurality of symbol-bearing reels on the main array includes a plurality of enhanced-array triggers. Each of the plurality of enhanced arrays includes a plurality of symbol-bearing reels and an enhancement feature. The enhancement feature of each enhanced array is different from any other enhancement feature of the plurality of enhanced arrays. Each of the plurality of enhanced arrays is associated with at least one of the plurality of enhanced-array triggers. The instructions further cause the gaming system to spin and evaluate the plurality of symbol-bearing reels on the enhanced array associated with a displayed enhanced-array trigger in response to the main array displaying at least one enhanced-array trigger.

According to another aspect of the invention, a method of conducting a wagering game on a gaming system includes receiving a wager in response to an input via at least one input device, displaying a main array including a plurality of symbol-bearing reels on at least one display device, displaying a first enhanced array and a second enhanced array on at least one display device, and spinning and evaluating the plurality of symbol-bearing reels on the main array in response to receiving a wager. The plurality of symbol-bearing reels on the main array includes a first enhanced-array trigger symbol associated with only the first enhanced array and a second enhanced-array trigger symbol associated with only the second enhanced array. Each of the enhanced arrays includes a plurality of symbol-bearing reels and an enhancement feature. The enhancement feature of each enhanced array is different from the enhancement features of any other enhanced array. The plurality of symbol-bearing reels on the first enhanced array are spun and evaluated in response to the first enhanced-array trigger symbol being displayed on the at least one display. The plurality of symbol-bearing reels on the second enhanced array are spun and evaluated in response to the second enhanced-array trigger symbol being displayed on the at least one display.

According to yet another aspect of the invention, a method of conducting a wagering game on a gaming system includes receiving a wager in response to an input via at least one input device, displaying a main array having a plurality of symbol-bearing reels on at least one display device, and displaying a plurality of enhanced arrays on at least one display device. The plurality of symbol-bearing reels on the main array includes a plurality of enhanced-array triggers. Each of the plurality of enhanced arrays includes a plurality of symbol-bearing reels and an enhancement feature. The enhancement feature of each enhanced array is different from any other enhancement feature of the plurality of enhanced arrays. Each of the plurality of enhanced arrays is associated with at least one of the plurality of enhanced-array triggers. The plurality of symbol-bearing reels on the main array are spun and evaluated in response to the received wager. The plurality of symbol-bearing reels of each enhanced array are spun and evaluated in response to the associated enhanced array-trigger being displayed on the main array.

Additional aspects of the invention will be apparent to those of ordinary skill in the art in view of the detailed description of various embodiments, which is made with reference to the drawings, a brief description of which is provided below.

Figure 1:
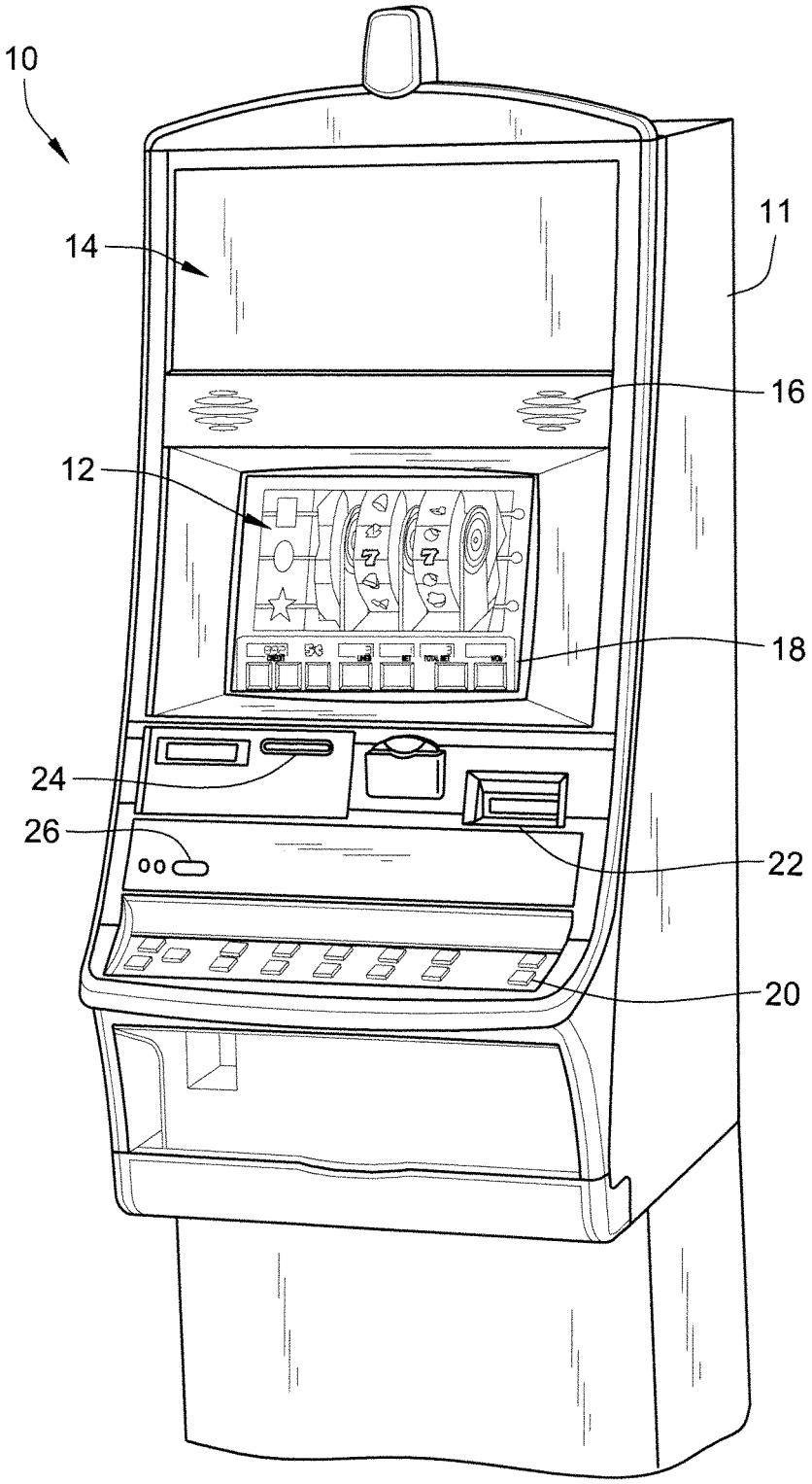
FIG. 1 (PRIOR ART)
FIG. 1 is a perspective view of a free-standing gaming terminal according to an embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

Referring to FIG. 1, there is shown a gaming terminal 10 similar to those used in gaming establishments, such as casinos. With regard to the present invention, the gaming terminal 10 may be any type of gaming terminal and may have varying structures and methods of operation. For example, in some aspects, the gaming terminal 10 is an electromechanical gaming terminal configured to play mechanical slots, whereas in other aspects, the gaming terminal is an electronic gaming terminal configured to play a video casino game, such as slots, keno, poker, blackjack, roulette, craps, etc. The gaming terminal 10 may take any suitable form, such as floor-standing models as shown, handheld mobile units, bartop models, workstation-type console models, etc. Further, the gaming terminal 10 may be primarily dedicated for use in conducting wagering games, or may include non-dedicated devices, such as mobile phones, personal digital assistants, personal computers, etc. Exemplary types of gaming terminals are disclosed in U.S. Pat. No. 6,517,433 and Patent Application Publication Nos. US2010/0069160 and US2010/0234099, which are incorporated herein by reference in their entireties.

The gaming terminal 10 illustrated in FIG. 1 comprises a cabinet 11 that may house various input devices, output devices, and input/output devices. By way of example, the gaming terminal 10 includes a primary display area 12, a secondary display area 14, and one or more audio speakers 16. The primary display area 12 or the secondary display area 14 may be a mechanical-reel display, a video display, or a combination thereof in which a transmissive video display is disposed in front of the mechanical-reel display to portray a video image superimposed upon the mechanical-reel display. The display areas may variously display information associated with wagering games, non-wagering games, community games, progressives, advertisements, services, premium entertainment, text messaging, emails, alerts, announcements, broadcast information, subscription information, etc. appropriate to the particular mode(s) of operation of the gaming terminal 10. The gaming terminal 10 includes a touch screen(s) 18 mounted over the primary or secondary areas, buttons 20 on a button panel, bill validator 22, information reader/writer(s) 24, and player-accessible port(s) 26 (e.g., audio output jack for headphones, video headset jack, USB port, wireless transmitter/receiver, etc.). It should be understood that numerous other peripheral devices and other elements exist and are readily utilizable in any number of combinations to create various forms of a gaming terminal in accord with the present concepts.

Input devices, such as the touch screen 18, buttons 20, a mouse, a joystick, a gesture-sensing device, a voice-recognition device, and a virtual input device, accept player input(s) and transform the player input(s) to electronic data signals indicative of the player input(s), which correspond to an enabled feature for such input(s) at a time of activation (e.g., pressing a "Max Bet" button or soft key to indicate a player's desire to place a maximum wager to play the wagering game). The input(s), once transformed into electronic data signals, are output to a CPU for processing. The electronic data signals are selected from a group consisting essentially of an electrical current, an electrical voltage, an electrical charge, an optical signal, an optical element, a magnetic signal, and a magnetic element.

Figure 2:
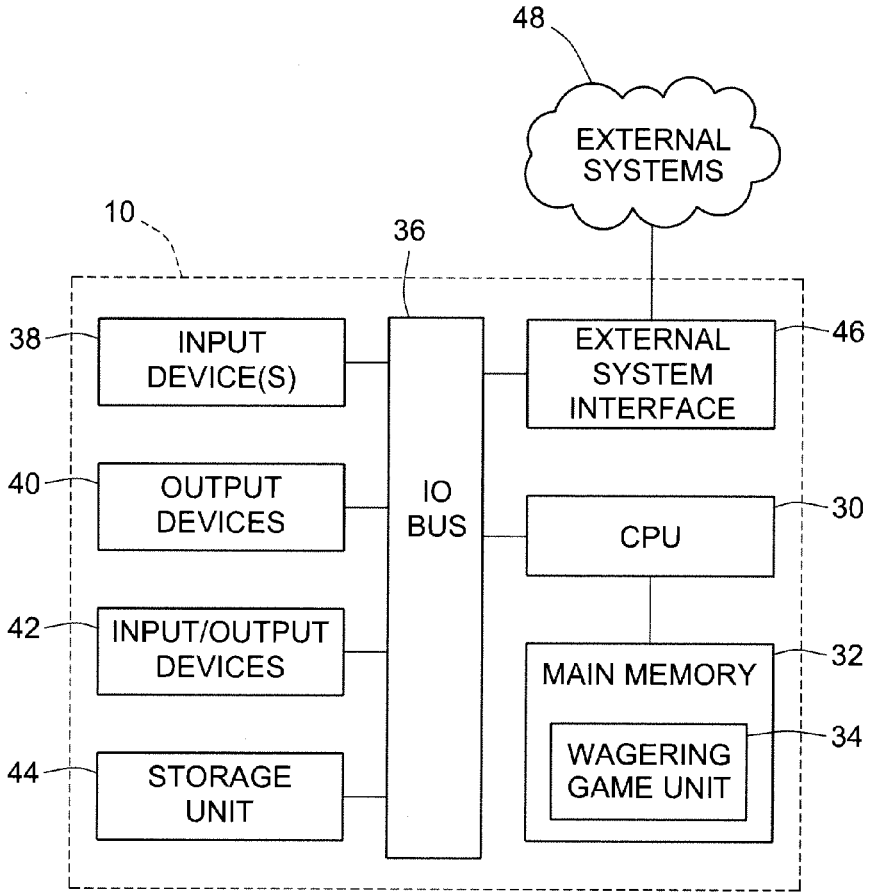
FIG. 2 (PRIOR ART)
FIG. 2 is a schematic view of a gaming system according to an embodiment of the present invention.

Turning now to FIG. 2, there is shown a block diagram of the gaming-terminal architecture. The gaming terminal 10 includes a central processing unit (CPU) 30 connected to a main memory 32. The CPU 30 may include any suitable processor(s), such as those made by Intel and AMD. By way of example, the CPU 30 includes a plurality of microprocessors including a master processor, a slave processor, and a secondary or parallel processor. CPU 30, as used herein, comprises any combination of hardware, software, or firmware disposed in or outside of the gaming terminal 10 that is configured to communicate with or control the transfer of data between the gaming terminal 10 and a bus, another computer, processor, device, service, or network. The CPU 30 comprises one or more controllers or processors and such one or more controllers or processors need not be disposed proximal to one another and may be located in different devices or in different locations. The CPU 30 is operable to execute all of the various gaming methods and other processes disclosed herein. The main memory 32 includes a wagering game unit 34. In one embodiment, the wagering game unit 34 may present wagering games, such as video poker, video black jack, video slots, video lottery, etc., in whole or part.

The CPU 30 is also connected to an input/output (I/O) bus 36, which can include any suitable bus technologies, such as an AGTL+frontside bus and a PCI backside bus. The I/O bus 36 is connected to various input devices 38, output devices 40, and input/output devices 42 such as those discussed above in connection with FIG. 1. The I/O bus 36 is also connected to storage unit 44 and external system interface 46, which is connected to external system(s) 48 (e.g., wagering game networks).

The external system 48 includes, in various aspects, a gaming network, other gaming terminals, a gaming server, a remote controller, communications hardware, or a variety of other interfaced systems or components, in any combination. In yet other aspects, the external system 48 may comprise a player's portable electronic device (e.g., cellular phone, electronic wallet, etc.) and the external system interface 46 is configured to facilitate wireless communication and data transfer between the portable electronic device and the CPU 30, such as by a near-field communication path operating via magnetic-field induction or a frequency-hopping spread spectrum RF signals (e.g., Bluetooth, etc.).

The gaming terminal 10 optionally communicates with the external system 48 such that the terminal operates as a thin, thick, or intermediate client. In general, a wagering game includes an RNG for generating a random number, game logic for determining the outcome based on the randomly generated number, and game assets (e.g., art, sound, etc.) for presenting the determined outcome to a player in an audio-visual manner. The RNG, game logic, and game assets are contained within the gaming terminal 10 ("thick client" gaming terminal), the external system 48 ("thin client" gaming terminal), or are distributed therebetween in any suitable manner ("intermediate client" gaming terminal).

The gaming terminal 10 may include additional peripheral devices or more than one of each component shown in FIG. 2. Any component of the gaming terminal architecture may include hardware, firmware, or tangible machine-readable storage media including instructions for performing the operations described herein. Machine-readable storage media includes any mechanism that stores information and provides the information in a form readable by a machine (e.g., gaming terminal, computer, etc.). For example, machine-readable storage media includes read only memory (ROM), random access memory (RAM), magnetic disk storage media, optical storage media, flash memory, etc.

Figure 3:
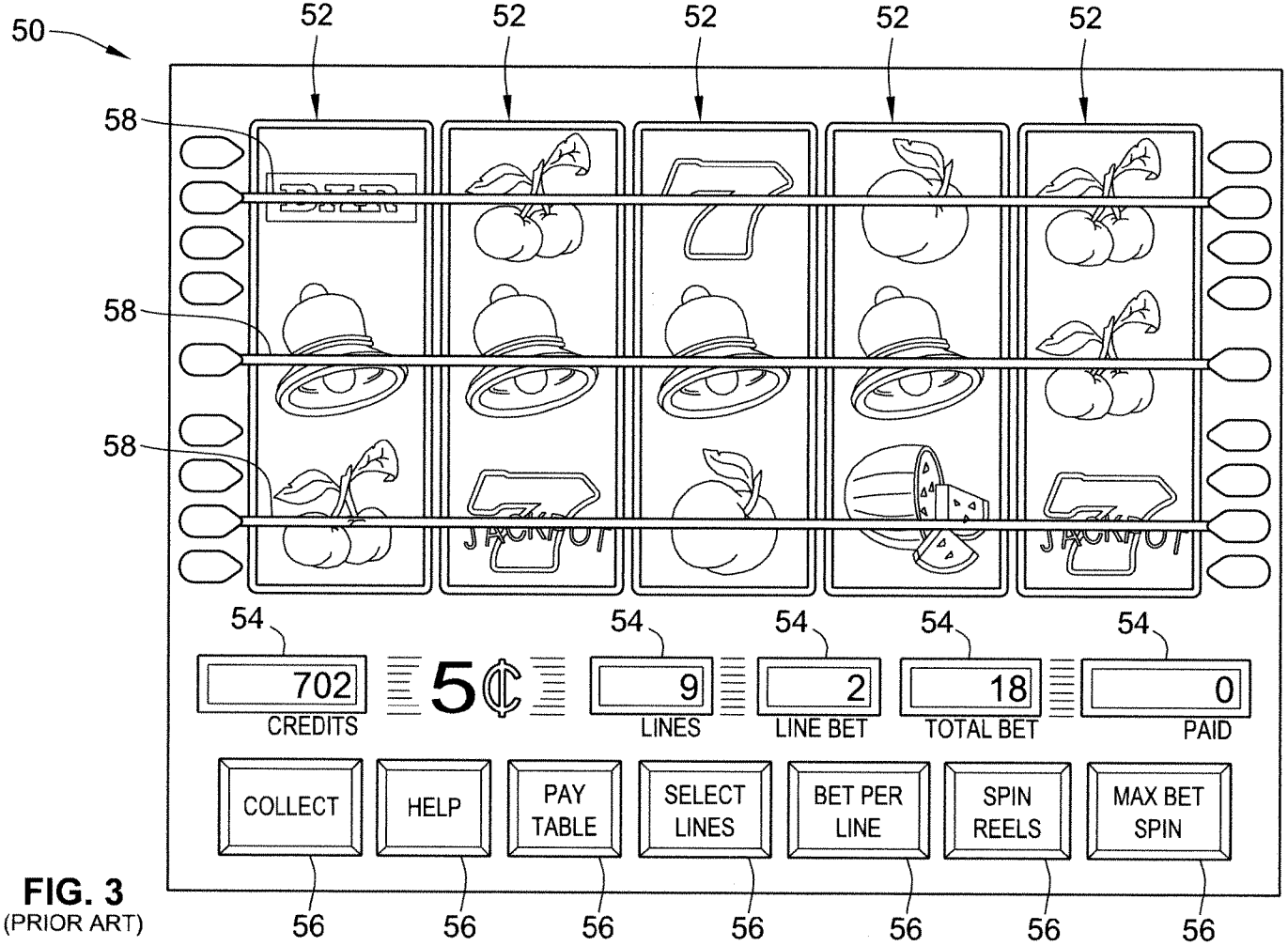
FIG. 3 (PRIOR ART)
FIG. 3 is an image of an exemplary basic-game screen of a wagering game displayed on a gaming terminal, according to an embodiment of the present invention.

Referring now to FIG. 3, there is illustrated an image of a basic-game screen 50 adapted to be displayed on the primary display area 12 or the secondary display area 14. The basic-game screen 50 portrays a plurality of simulated symbol-bearing reels 52. Alternatively or additionally, the basic-game screen 50 portrays a plurality of mechanical reels or other video or mechanical presentation consistent with the game format and theme. The basic-game screen 50 also advantageously displays one or more game-session credit meters 54 and various touch screen buttons 56 adapted to be actuated by a player. A player can operate or interact with the wagering game using these touch screen buttons or other input devices such as the buttons 20 shown in FIG. 1. The CPU operate(s) to execute a wagering game program causing the primary display area 12 or the secondary display area 14 to display the wagering game.

In response to receiving a wager, the reels 52 are rotated and stopped to place symbols on the reels in visual association with paylines such as paylines 58. The wagering game evaluates the displayed array of symbols on the stopped reels and provides immediate awards and bonus features in accordance with a pay table. The pay table may, for example, include "line pays" or "scatter pays." Line pays occur when a predetermined type and number of symbols appear along an activated payline, typically in a particular order such as left to right, right to left, top to bottom, bottom to top, etc. Scatter pays occur when a predetermined type and number of symbols appear anywhere in the displayed array without regard to position or paylines. Similarly, the wagering game may trigger bonus features based on one or more bonus triggering symbols appearing along an activated payline (i.e., "line trigger") or anywhere in the displayed array (i.e., "scatter trigger"). The wagering game may also provide mystery awards and features independent of the symbols appearing in the displayed array.

In accord with various methods of conducting a wagering game on a gaming system in accord with the present concepts, the wagering game includes a game sequence in which a player makes a wager and a wagering game outcome is provided or displayed in response to the wager being received or detected. The wagering game outcome is then revealed to the player in due course following initiation of the wagering game. The method comprises the acts of conducting the wagering game using a gaming apparatus, such as the gaming terminal 10 depicted in FIG. 1, following receipt of an input from the player to initiate the wagering game. The gaming terminal 10 then communicates the wagering game outcome to the player via one or more output devices (e.g., primary display 12 or secondary display 14) through the display of information such as, but not limited to, text, graphics, static images, moving images, etc., or any combination thereof. In accord with the method of conducting the wagering game, the CPU transforms a physical player input, such as a player's pressing of a "Spin Reels" touch key, into an electronic data signal indicative of an instruction relating to the wagering game (e.g., an electronic data signal bearing data on a wager amount).

In the aforementioned method, for each data signal, the CPU (e.g., CPU 30) is configured to process the electronic data signal, to interpret the data signal (e.g., data signals corresponding to a wager input), and to cause further actions associated with the interpretation of the signal in accord with computer instructions relating to such further actions executed by the controller. As one example, the CPU causes the recording of a digital representation of the wager in one or more storage media (e.g., storage unit 44), the CPU, in accord with associated computer instructions, causing the changing of a state of the storage media from a first state to a second state. This change in state is, for example, effected by changing a magnetization pattern on a magnetically coated surface of a magnetic storage media or changing a magnetic state of a ferromagnetic surface of a magneto-optical disc storage media, a change in state of transistors or capacitors in a volatile or a non-volatile semiconductor memory (e.g., DRAM), etc. The noted second state of the data storage media comprises storage in the storage media of data representing the electronic data signal from the CPU (e.g., the wager in the present example). As another example, the CPU further, in accord with the execution of the instructions relating to the wagering game, causes the primary display 12, other display device, or other output device (e.g., speakers, lights, communication device, etc.) to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of computer instructions relating to the wagering game is further conducted in accord with a random outcome (e.g., determined by a RNG) that is used by the CPU to determine the outcome of the game sequence, using a game logic for determining the outcome based on the randomly generated number. In at least some aspects, the CPU is configured to determine an outcome of the game sequence at least partially in response to the random parameter.

Figure 4A:
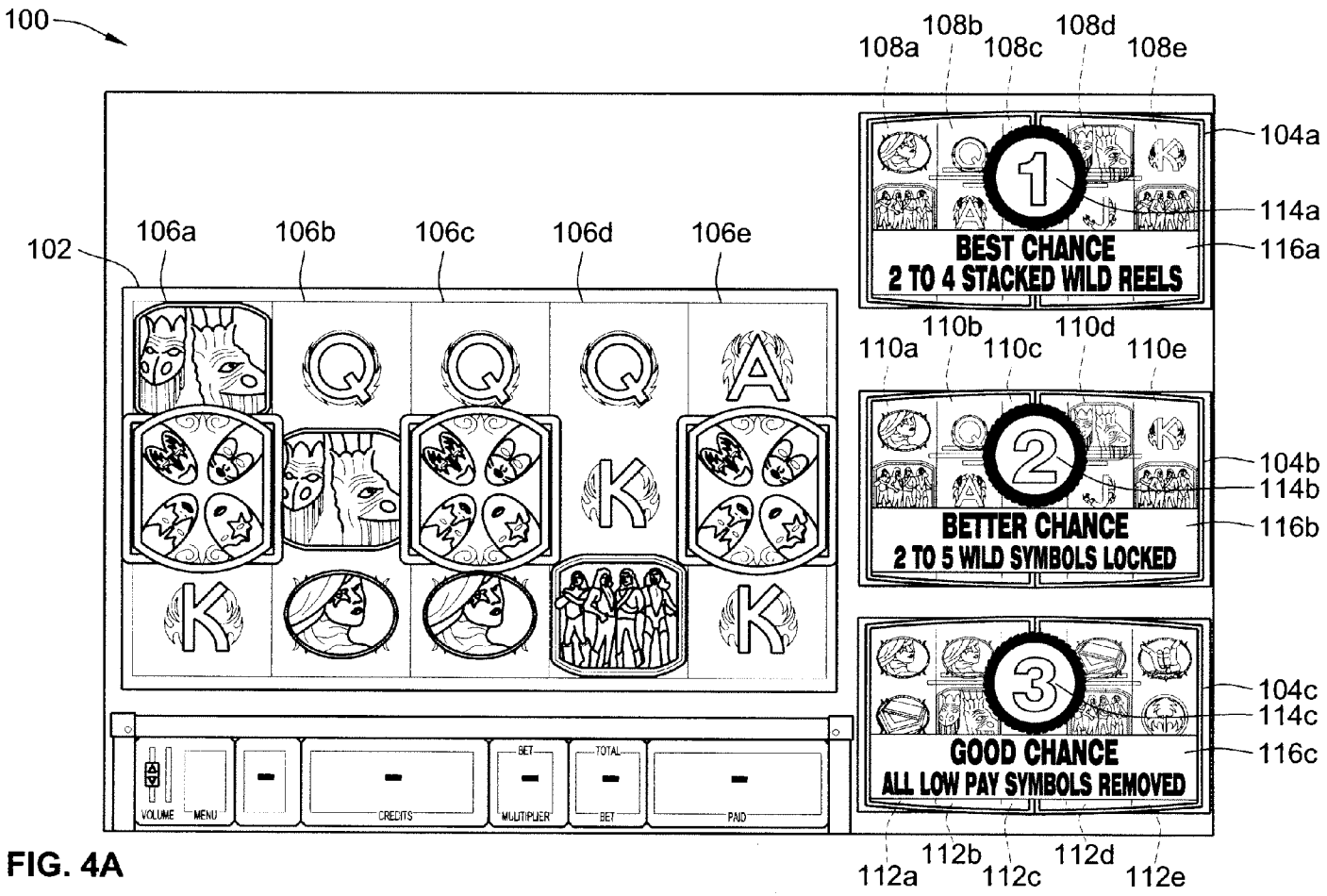
FIG. 4A is an exemplary screen having a main array and three locked enhanced arrays.
Figure 4B:
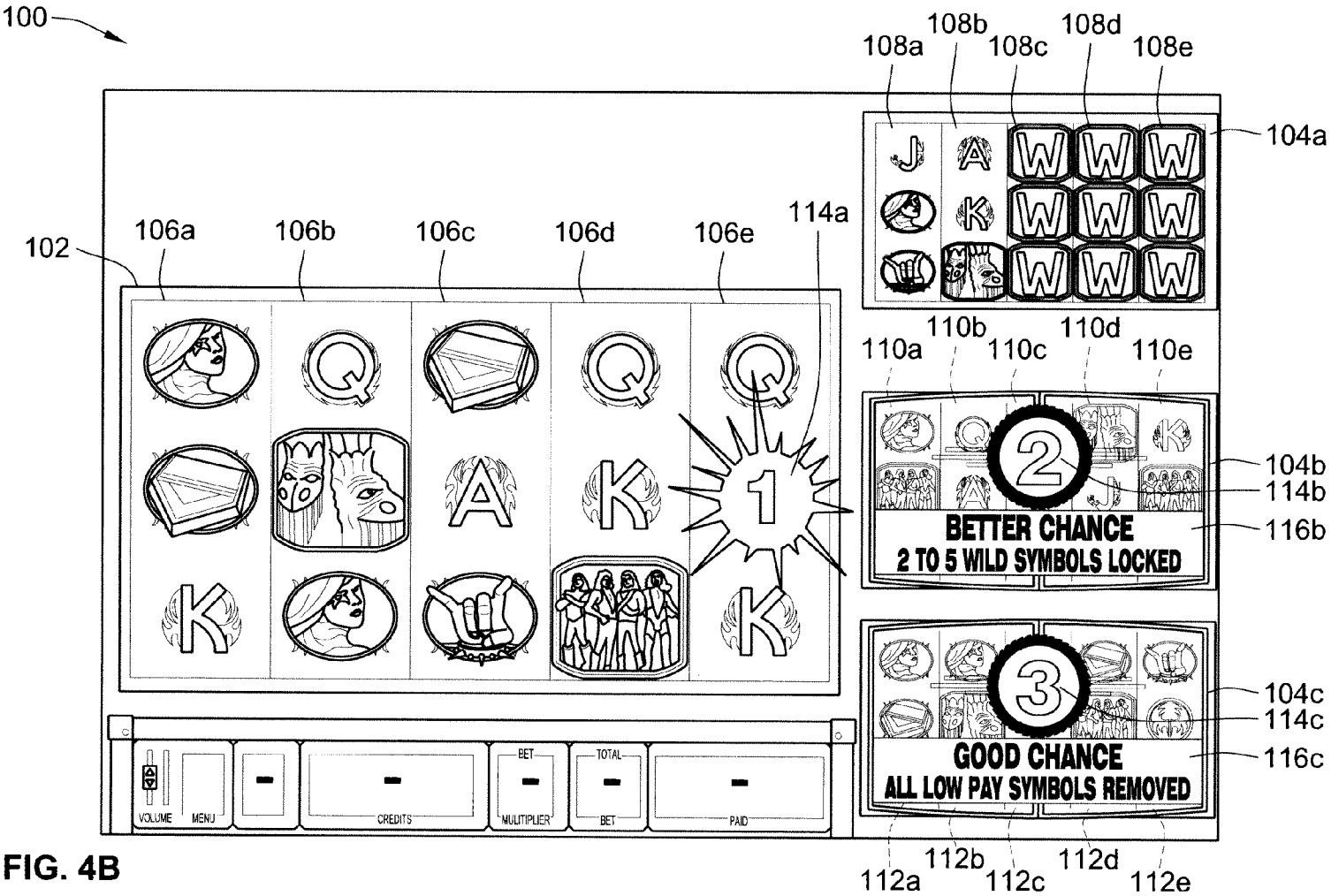
FIG. 4B is the exemplary screen of FIG. 4A having one of the enhanced arrays unlocked.
Figure 4C:
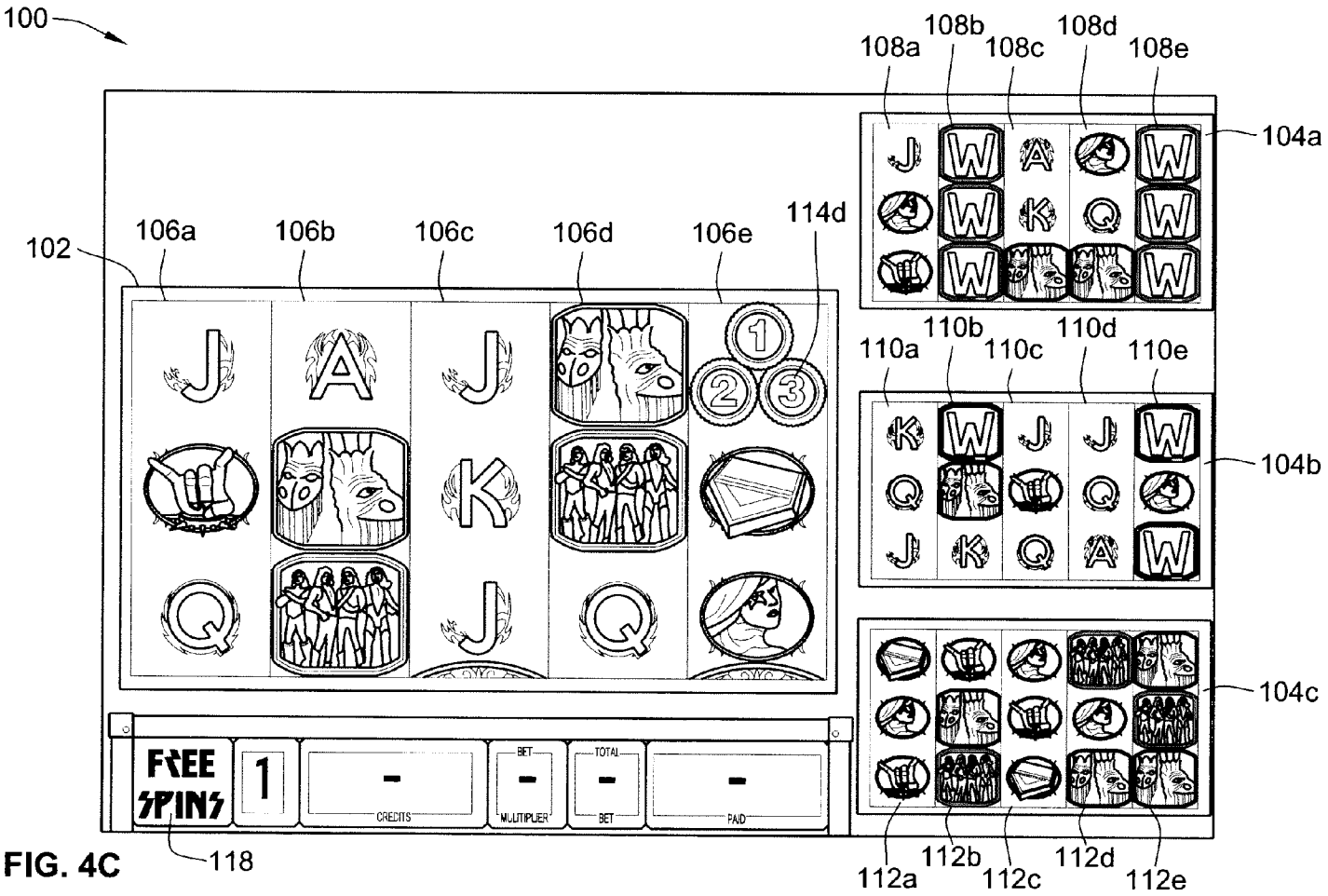
FIG. 4C is the exemplary screen of FIG. 4A having all of the enhanced arrays unlocked.

Referring now to FIGS. 4A-4C, a wagering game screen 100 is shown. The wagering game screen 100 includes a main array 102 and three enhanced arrays 104*a*-104*c*. The main array 102 includes a plurality of main-array reels 106*a*-106*e*. A first enhanced array 104*a* includes a plurality of first-enhanced-array reels 108*a*-108*e*. Similarly, a second enhanced array 104*b* includes a plurality of second-enhanced-array reels 110*a*-110*e* and a third enhanced array 104*c* includes a plurality of third-enhanced-array reels 112*a*-112*e*. The main array 102 may be presented in either a base game or a bonus event of the wagering game. Similarly, the enhanced arrays 104*a*-104*c* may be displayed with the main array 102 or as a separate bonus feature. The enhanced arrays 104*a*-104*c* are locked until a triggering condition is met.

Referring now to FIG. 4A, each of the enhanced arrays 104*a*-104*c* is visually associated with a respective enhanced-array trigger symbol 114*a*-114*c* when locked. Additionally, this display informs the player of the particular enhanced-array trigger symbol 114*a*-114*c* required to unlock the particular enhanced array 104*a*-104*c*. When locked, the enhanced arrays 104*a*-104*c* are not eligible to provide an award to a player in response to a winning combination. It is contemplated that other methods may be used to signify when an enhanced array is not currently in play.

Each enhanced array 104*a*-104*c* also includes at least one enhancement feature 116*a*-116*c* associated with it. As will be described in detail in connection with FIG. 4B, the first enhanced array 104*a* is associated with a "wild reels" enhancement feature 116*a*. As will be described in connection with FIG. 4C, the second enhanced array 104*b* is associated with a "random wilds" enhancement feature 116*b* and the third enhanced array 104*c* is associated with a "reduced symbol set" enhancement feature 116*c*. It is contemplated that other enhancement features may be used such as free spins, an increased number of bonus event trigger symbols, respins, additional paylines, clumped symbols, locking symbols, loaded reels, etc. Additionally, multiple enhancements may be used on any of the three enhanced arrays 104*a*-104*c* and/or the enhanced arrays 104*a*-104*c* may share some enhancement features.

Referring now to FIG. 4B, the main array 102 is shown displaying a triggering condition to unlock an enhanced array. In this embodiment, the triggering condition is any enhanced-array trigger symbol 114*a*-114*d* being displayed on the rightmost main-array reel 106*e*. The enhanced-array trigger symbol 114*a*-114*d* "unlocks" the particular enhanced array 104*a*-104*c* or particular enhanced arrays associated with it. After the wagering game outcome is determined and a first-enhanced-array trigger symbol 114*a* is displayed, the first enhanced array 104*a* (i.e., the enhanced array associated with trigger symbol 114*a*) is unlocked and the display of the first enhanced array 104*a* is altered. The illustrated "wild reels" enhancement feature 116*a* (FIG. 4A) is utilized in the first enhanced array 104*a* by the gaming system. The gaming system selects a random number of the first-enhanced-array reels 108*a*-108*e* to be replaced with wild reels. In the illustrated embodiment, the number of reels to be replaced ranges from two to four. The gaming system then selects the positions of the first-enhanced-array reels 108*a*-108*e* to be replaced with the wild reels. In the illustrated embodiment, the CPU 30 has randomly selected the three rightmost first-enhanced-array reels 108*c*-108*e* to be replaced by wild reels. In some embodiments, the selected wild reels are locked in place while the remaining two leftmost first-enhanced-array reels 108*a* and 108*b* are spun. A game outcome is determined based on the arrangement of symbols randomly selected from spinning the two leftmost first-enhanced-array reels 108*a* and 108*b* combined with the wild symbols already selected on the three rightmost first-enhanced-array reels 108*c*-108*d*.

Referring now to FIG. 4C, a multiple-enhanced-array trigger symbol 114*d* is displayed on the fifth reel 106*e* of the main array 102 and is associated with all three enhanced arrays 104*a*-104*c*. It is contemplated that additional combinations of enhanced-array trigger symbols 114*a*-114*d* may be included that are associated with more than one, but less than all, of the enhanced arrays 104*a*-104*b*. As described above, the "wild reels" enhancement feature 116*a* (FIG. 4A) is applied to the first enhanced array 104*a*. In this illustration, the second first-enhanced-array reel 108*b* and the rightmost first-enhanced-array reel 108*e* were selected to be wild reels using the method stated above.

The "random wilds" enhancement feature 116*b* (FIG. 4A) is applied to the second enhanced array 104*b* when the second enhanced array 104*b* is unlocked. The illustrated "random wilds" enhancement feature 116*b* (FIG. 4A) is applied to the second enhanced array 104*b* by the gaming system. The gaming system selects a random number of symbols to be replaced on the second enhanced array 104*b*. In the illustrated embodiment, the number of symbols to be replaced ranges from two to five. The gaming system selects the positions of the symbols to be replaced on second-enhanced-array reels 110*a*-110*e* to be replaced by wild symbols. In the illustrated embodiment, the CPU 30 has randomly selected three array positions to be replaced with wild symbols. These array positions are located at the top of the second second-enhanced-array reel 110*b*, as well as the top and bottom of the rightmost second-enhanced-array reel 110*e*. In some embodiments, the selected wild symbols are locked in place on the second enhanced array 104*b* while the second-enhanced-array reels 110*a*-110*e* are spun. A game outcome is then determined based on the locked wild symbols and on the randomly selected symbols displayed on the remaining positions of the second enhanced array 104*b*.

The illustrated "reduced symbol set" enhancement feature 116*c* (FIG. 4A) is applied to the third enhanced array 104*c* by the gaming system after the third enhanced array 104*c* is unlocked. In the illustrated embodiment, the "reduced symbol set" enhancement feature 116*c* includes a plurality of symbols arranged on the plurality of the third-enhanced-array reels 112*a*-112*e* of the third enhanced array 104*c*. The set of symbols on the third-enhanced-array reels 112*a*-112*e* includes symbols used on the main array 102, but excludes the lowest paying symbols in that set. The number of symbols excluded from the third-enhanced-array reels 112*a*-112*e* may be varied to achieve a desired result. By way of non-limiting example, the set of excluded symbols can be a predetermined set or can be randomly determined by the gaming system during play of the wagering game.

Figure 5:
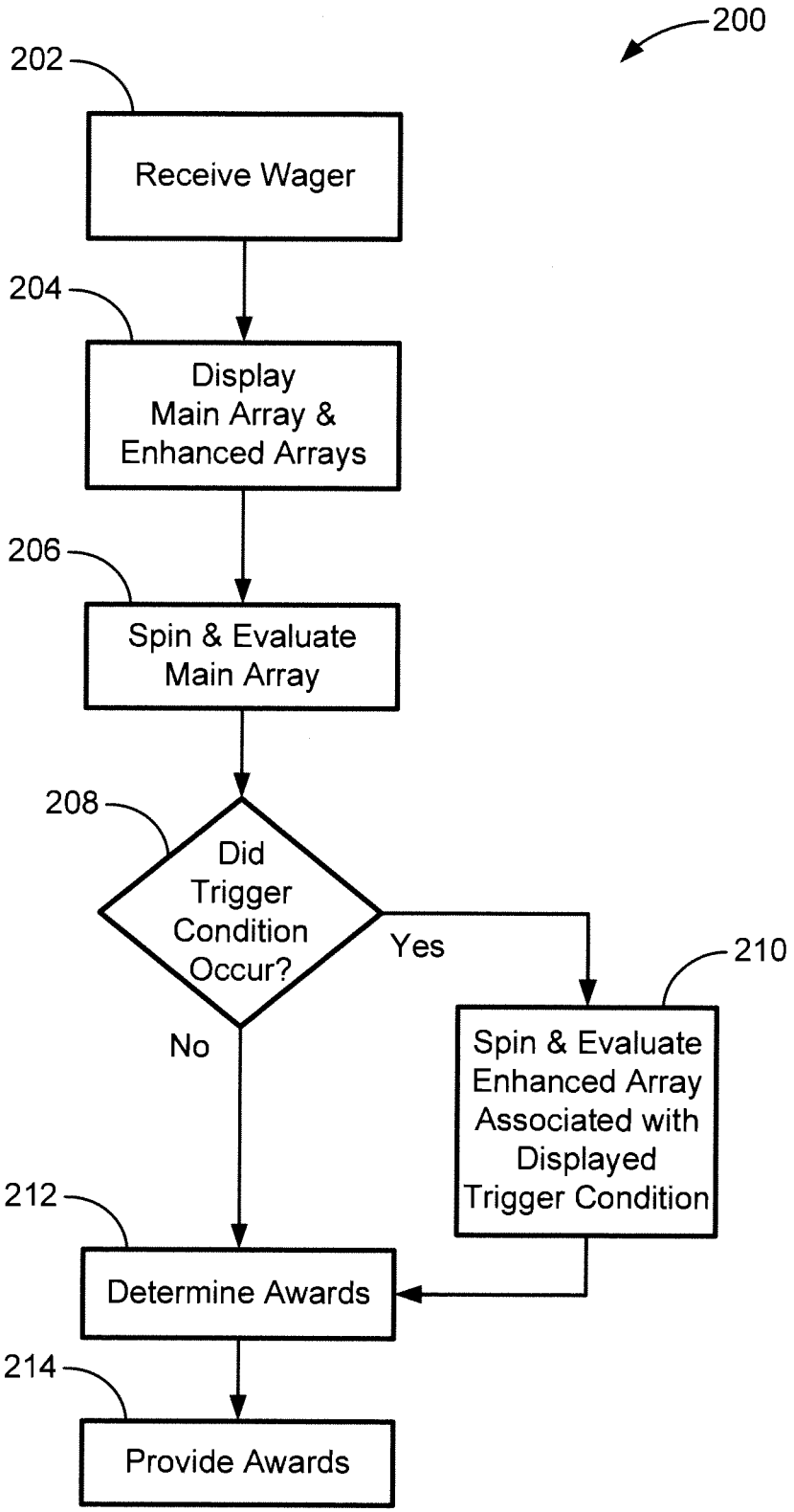
FIG. 5 is a flowchart for an algorithm that corresponds to instructions executed by a controller in accord with at least some aspects of the disclosed concepts.

FIG. 5 illustrates a schematic depiction of one algorithm that corresponds to at least some instructions that can be executed by the CPU 30 and/or external systems 48 to perform the above described functions associated with the disclosed concepts. By way of non-limiting example, the exemplary algorithm 200 includes receiving a wager, at step 202, from a player to initiate a wagering game. The wager is placed or otherwise confirmed, for example, using a bill validator 22, coin acceptor, information reader 24, or other input device. A main array and enhanced arrays are displayed at step 204 (e.g., the main array 102 and enhanced arrays 104*a*-104*c* of FIG. 4A). It is contemplated that the main array and the enhanced arrays can also be displayed prior to initiation of the wagering game.

After receiving the wager from the player, a game outcome is generated. In the illustrated embodiment, the main array includes a plurality of symbol-bearing reels that are spun and evaluated at step 206 (e.g., the main-array reels 106*a*-106*e* of FIGS. 4A-4C). It is determined, at decision box 208, whether a triggering condition has occurred that enables play of any enhanced arrays (e.g., as shown in FIG. 4B, the first-enhanced-array trigger symbol 114*a* being displayed on the rightmost main-array reel 106*e* allows play of the first enhanced array 104*a*). If a triggering condition has not occurred, an award determination is made at step 212 to evaluate whether the main array resulted in an award to the player. Alternatively, if a triggering condition has occurred, at least one enhanced array associated with the triggering condition is unlocked and the symbol-bearing reels on the unlocked enhanced array are spun and evaluated at step 210.

In the illustrated embodiment, the unlocked enhanced array includes a plurality of symbol-bearing reels (e.g., the first-enhanced-array reels 108*a*-108*e* shown in FIG. 4B). It is contemplated that multiple triggering conditions may occur simultaneously and that either all or fewer than all enhanced arrays associated with the triggering conditions may be played. It is further contemplated that multiple enhanced arrays may be associated with a single trigger symbol (e.g., the multiple-enhanced-array trigger symbol 114*d* shown in FIG. 4C). After the enhanced array has been spun and evaluated at step 210, an award determination is made at step 212 to evaluate whether the main array, enhanced array, both, or neither resulted in an award to the player. These awards are based on, for example, combinations of symbols displayed on the main array and symbols displayed on any unlocked array. The player is provided with any determined awards at step 214 and play of the wagering game may continue.

In some embodiments, play of the unlocked enhanced arrays can unlock other of the enhanced arrays or cause the main array to respin. For example, play of the first enhanced array 104*a* can result in displaying a second-enhanced-array trigger symbol 114*b* that unlocks the second enhanced array 104*b*. Or, in another example, play of the first enhanced array 104*a* can result in a respin symbol that causes the main array 102 to respin one or more times. Furthermore, the respinning of the main array 102 can potentially unlock other enhanced arrays, for example, a third-enhanced-array trigger symbol 114*c* unlocks the third enhanced array 104*c*.

In some embodiments, the number of enhanced-array trigger symbols 114*a*-114*d* increases if a free-spin bonus game is triggered on the main array 102. In this embodiment, the plurality of main-array reels 106*a*-106*e* includes only three enhanced-array trigger symbols 114*a*-114*c* during the base game, each of the enhanced-array trigger symbols 114*a*-114*c* being able to unlock a single and distinct one of the enhanced arrays 104*a*-104*c*. When a free-spin bonus is initiated, as indicated by an information area 118 (FIG. 4C), the multiple-enhanced-array trigger symbol 114*d* is added to the plurality of symbol positions on at least one of the main-array reels 106*a*-106*e*. The multiple-enhanced-array trigger symbol 114*d* is able to unlock all three enhanced arrays 104*a*-104*c* simultaneously. Alternatively, during a free-spin bonus game, all of the single, enhanced-array trigger symbols 114*a*-114*c* convert to multiple-enhanced-array trigger symbols 114*d*.

In yet other embodiments, the number of enhanced-array trigger symbols 114*a*-114*d* does not change when the free-spin bonus is initiated. In this embodiment, an enhanced array that becomes unlocked due to a triggering condition remains unlocked and is spun and evaluated for the remainder of the free spins. For example, if the free-spin bonus has ten free spins and the first enhanced array 104*a* is unlocked during the third free spin, the first enhanced array 104*a* remains unlocked and is spun and evaluated for each of the remaining seven spins (in addition to the third spin).

While the present devices have been described using a single-symbol trigger on the rightmost main-array reel 106*e*, it is contemplated that a single-symbol trigger may be implemented on any of the main-array reels 106*a*-106*e*. In alternative embodiments, a combination of symbols or a specific placement of symbols may be required to unlock the enhanced arrays. This requirement can include a trigger with three symbols where all three symbols indicate the enhanced array to be unlocked. For example, in reference to FIG. 4B, two additional first-enhanced-array trigger symbols 114*a* would be required to be displayed on any of the main-array reels 106*a*-106*e*. Alternatively, the three first-enhanced-array trigger symbols 114*a* could be required to be located in a specific location or orientation (e.g., all three symbols must be located in a top position on any of the main-array reels 106*a*-106*e* of the main array 102). In yet another alternative, the three symbols could be different from one another (e.g., one symbol identifies the enhanced array to be unlocked and the other two symbols are generic bonus symbols).

Each of these embodiments and obvious variations thereof is contemplated as falling within the spirit and scope of the claimed invention, which is set forth in the following claims.

What is claimed is:

1. A method of operating a gaming system primarily dedicated to playing a casino wagering game, the gaming system including a gaming cabinet, one or more controllers, one or more electronic display devices, and at least one electronic input device configured to receive a physical item associated with a monetary value, the monetary value establishing a credit balance displayed on a credit meter, the one or more electronic display devices and the at least one electronic input device being coupled to the gaming cabinet, the method comprising:

initiating, responsive to a wager input indicating a wager amount covered by the credit balance, the casino wagering game;

determining, by the one or more controllers, a randomly generated outcome of the casino wagering game;

displaying, for a play of the casino wagering game on at least one of the one or more electronic display devices, a main array having a plurality of symbol-bearing reels including a plurality of enhanced-array triggers;

displaying, simultaneously with displaying the main array for the play of the casino wagering game, on at least one of the one or more electronic display devices, a plurality of enhanced arrays, each of the plurality of enhanced arrays having a plurality of symbol-bearing reels and including an enhancement feature that affects at least one of (i) one or more symbols displayed on any of the symbol-bearing reels of an enhanced array or the main array, or (ii) a number of reel spins of any of the enhanced arrays or the main array, wherein a first enhancement feature of a first of the plurality of enhanced arrays is different from a second enhancement feature of a second of the plurality of enhanced arrays and each of the plurality of enhanced arrays is associated with at least one of the plurality of enhanced-array triggers;

in response to receiving the wager input, spinning the plurality of symbol-bearing reels of the main array to display symbol combinations representative of the randomly generated outcome and evaluating, by at least one of one or more controllers, the displayed symbol combinations on the plurality of symbol-bearing reels of the main array;

in response to displaying at least one of the plurality of enhanced-array triggers, unlocking, by at least one of the one or more controllers, an associated array of the plurality of enhanced arrays;

spinning, by at least one of the one or more controllers, the plurality of symbol-bearing reels of the unlocked associated array to display symbol combinations representative of the randomly generated outcome and evaluating the displayed symbol combinations on the plurality of symbol-bearing reels on the unlocked associated array; and awarding an award in response to the displayed symbol combinations on the symbol-bearing reels of at least one of the main array or an unlocked enhanced array of the plurality of enhanced arrays meeting one or more predetermined criteria.

2. The method of claim 1, wherein the plurality of symbol-bearing reels in the first enhanced array includes at least one enhanced-array trigger associated with the second enhanced array.

3. A gaming system comprising:

a gaming machine primarily dedicated to playing a casino wagering game, the gaming machine including a gaming cabinet, at least one electronic display device coupled to the gaming cabinet, one or more electronic input devices coupled to the gaming cabinet, and at least one of the one or more electronic input devices configured to receive a physical item associated with a monetary value, the monetary value establishing a credit balance; and one or more controllers configured to:

initiate the casino wagering game responsive to a wager input committing a wager amount from the credit balance;

direct the at least one electronic display device to simultaneously display, for a play of the casino wagering game, a main array of symbol-bearing reels, a locked first enhanced array of symbol-bearing reels, and a locked second enhanced array of symbol-bearing reels, the first and second enhanced arrays having different respective first and second enhancement features;

spin and evaluate the main array;

in response to a first enhanced-array trigger resulting from the spin of the main array, unlock, spin and evaluate the first enhanced array in accordance with the first enhancement feature;

in response to a second, different enhanced-array trigger resulting from the spin of the main array, unlock, spin and evaluate the second enhanced array; and in response to displayed symbols on the spun main array, the spun first enhanced array, or the spun second enhanced array meeting one or more predetermined criteria, provide an award.

4. The gaming system of claim 3, wherein the first and second enhanced-array triggers are occurrences of respective first and second enhanced-array trigger symbols being displayed on the corresponding main array.

5. The gaming system of claim 4, wherein the one or more controllers are configured to execute a bonus event triggered during the casino wagering game, and wherein an initial number of the first enhanced-array trigger symbols included in the main array is modified during the bonus event.

6. The gaming system of claim 4, wherein the one or more controllers are configured to execute a bonus event triggered during the casino wagering game, and wherein an initial number of second enhanced-array trigger symbols included in the main array is modified during the bonus event.

7. The gaming system of claim 5, wherein the initial number is increased during the bonus event.

8. The gaming system of claim 6, wherein the initial number is increased during the bonus event.

9. The gaming system of claim 3, wherein, in response to the occurrence of a multi-array enhanced-array trigger, the one or more controllers are further configured to unlock, spin and evaluate more than one of the enhanced arrays.

10. The gaming system of claim 3, wherein the one or more controllers are further configured to execute a multiple-free-spin bonus event triggered during the casino wagering game, the multiple-free-spin bonus event including:

unlocking an enhanced-array during one of the multiple free spins; and spinning and evaluating the main array and any unlocked enhanced arrays for each remaining free spin of the multiple free spins.

11. The gaming system of claim 3, wherein, in response to a multi-array enhanced-array trigger resulting from the spin of the second enhanced array, the one or more controllers are further configured to re-spin and re-evaluate the first and second enhanced arrays.

12. The gaming system of claim 3, wherein the award includes an award value added to the credit balance.

13. A method of operating a gaming system, the gaming system including one or more controllers and a gaming machine primarily dedicated to playing at least one casino wagering game, the gaming machine including a gaming cabinet, one or more electronic display devices, and one or more electronic input devices, the one or more electronic display devices and electronic input devices being coupled to the gaming cabinet, the method comprising:

detecting, via at least one of the one or more electronic input devices, a physical item associated with a monetary value, the monetary value establishing a credit balance displayed on a credit meter on at least one of the one or more electronic display devices;

initiating the casino wagering game in response to a wager input indicating a wager amount covered by the credit balance;

displaying, on at least one of the one or more electronic display devices, a main array of symbol-bearing reels, a locked first enhanced array of symbol-bearing reels associated with a first feature enhancement, and a locked second enhanced array of symbol-bearing reels associated with a second feature enhancement, the main array, first enhanced array, and second enhanced array being displayed simultaneously for a play of the casino wagering game;

spinning and evaluating the main array;

in response to a first enhanced-trigger resulting from the spin of the main array, unlocking, spinning, and evaluating the first enhanced array according to the first feature enhancement; and in response to a second, different enhanced-trigger resulting from the spin of the main array, unlocking, spinning, and evaluating the second enhanced array according to the second feature enhancement.

14. The method of claim 13, further comprising, in response to displayed symbols on at least one of the spun main array, the spun first enhanced array, or the spun second enhanced array meeting one or more predetermined criteria, providing an award.

15. The method of claim 13, wherein the first enhanced-array trigger is a single occurrence of a first designated symbol displayed in the main array.

16. The method of claim 15, further comprising triggering a bonus event during the casino wagering game, and wherein an initial number of first designated symbols on the symbol-bearing reels of the main array is modified during the bonus event.

17. The method of claim 16, wherein the bonus event is a free-spins bonus, the method further comprising, in response to triggering the bonus event, spinning the main array and all unlocked enhanced arrays and evaluating the spun arrays until all of the free spins completed, and wherein the first enhanced array is unlocked in response to the first enhanced-array trigger resulting from one of the free spins and the second enhanced array is unlocked in response to the second enhanced-array trigger resulting from one of the free spins.

18. The method of claim 17, wherein the first enhanced array and the second enhanced array remain unlocked for any remaining free spins.

19. The method of claim 13, further comprising, in response to a multi-array enhanced-array trigger resulting from the spin of the main array, spinning and evaluating at least two of the enhanced arrays.

20. The method of claim 13, further comprising, in response to the first enhanced-array trigger resulting from the spin of the second enhanced array or the second-enhanced array trigger resulting from the spin of the first enhanced array, spinning and evaluating the first enhanced array or the second enhanced array, respectively.

* * * * *